US005138220A

United States Patent [19]

Kirkpatrick

[11] Patent Number: 5,138,220

[45] Date of Patent: Aug. 11, 1992

[54] FIELD EMISSION CATHODE OF BIO-MOLECULAR OR SEMICONDUCTOR-METAL EUTECTIC COMPOSITE MICROSTRUCTURES

[75] Inventor: Douglas A. Kirkpatrick, Laurel, Md.

[73] Assignee: Science Applications International Corporation, San Diego, Calif.

[21] Appl. No.: 623,623

[22] Filed: Dec. 5, 1990

[51] Int. Cl.[5] ..... H01J 1/30

[52] U.S. Cl. ..... 313/309; 313/310; 313/336; 428/389

[58] Field of Search ..... 313/309, 310, 336; 428/389

[56] References Cited

U.S. PATENT DOCUMENTS

| | | | |
|---|---|---|---|
| 3,720,856 | 3/1973 | Brody | 313/309 |
| 3,755,704 | 8/1973 | Spindt et al. | 313/309 |
| 3,812,559 | 5/1974 | Spindt et al. | 313/309 X |
| 4,686,414 | 8/1987 | McKenna et al. | 313/336 X |
| 4,721,885 | 1/1988 | Brodie | 313/309 X |
| 4,911,981 | 3/1990 | Schnur et al. | 428/389 X |
| 4,940,916 | 7/1990 | Borel et al. | 313/309 X |

FOREIGN PATENT DOCUMENTS

| | | | |
|---|---|---|---|
| 0028447 | 6/1982 | Japan | 313/309 |

OTHER PUBLICATIONS

Roberson, C. W., "Bright Electron Beams for Free Electron Lasers", Proc. Soc. Photo-Opt. Int. Eng. 453, 320–327; Jul. 1983.

KirkPatrick, D. A., Bekefi, G., DiRienzo, A. C., Freund, H. P., and Ganguly, A. K., "A Millimeter and Submillimeter Wavelength Free-Electron Laser", Phys. Fluids B 1, 1511, Jul. 1989.

Thomas, R. E., Gibson, J. W., Haas, G. A., Abrams, R. H., Jr., "Thermionic Sources for High-Brightness Electron Beams", IEEE Trans. Elec. Dev. 37 850 (Mar. 1990).

Spindt, C. A., Brodie, I., Humphrey, L. and Westerberg, E. R., "Physical Properties of Thin-Film Field Emission Cathodes with Molybdenum Cones", J. Appl. Phys. 47, 5248 (Dec. 1976).

Spindt, C. A., Holland, C. E., and Stowell, R. D., "Field Emission Cathode Array Development for High-Current-Density Applications", Appl. Surf. Sci, 16, 268 (Sep. 1982).

Yager, P., Schoen, P. E., "Formation of Tubules by a Polymerizable Surfactant", Mol. Cryst. Liq. Cryst. 371–381, Dec. 1984.

Yager, P., Schoen, P. E., Davies, C., Price, R. and Singh, A., "Structure of Lipid Tubules Formed from a Polymerizable Lecithin", Biophys. J. 48, 899–906; (Dec. 1985).

Schnur, J. M., Price, R., Schoen, P., Yager, P., Calvert, J. M., Georger, J., and Singh, A., "Lipid-Based Tubule Microstructures", Thin Solid Films, 152, 181–206 (Feb. 1987).

Georger, J., Singh, A., Price, R., Schnur, J., Yager, P., Schoen, P., "Helical and Tubular Microstructures Formed by Polymerizable Phosphatidylcholines", J. Am. Chem. Soc. 109, 6169–6175; Dec. 1987.

Behroozi, F., Orman, M., Reese, R., Stockton, W., Calvert, J., Rachford, F., and Schoen, P. "Interaction of Metallized Tubules with Electromagnetic Radiation", J. Applied Physics 68, 3688–3693; May 1990.

Ditchek, B., Middleton, T., Rossoni, P. and Yacobi, B. "Novel High Voltage Transistor Fabricated Using the In Situ Junctions in a Si-$TaSi_2$Eutectic Composite", Appl. Phys. Lett. 52, 1147–1149; Feb. 1988.

Ditchek, B. and Levinson, M. "Si-$TaSi_2$in situ Junction Eutectic Composite Diodes", Appl. Phys. Lett. 49, 1656–1658; Oct. 1986.

Lau, Y. "Effects of Cathode Surface Roughness on the Quality of Electron Beams", J. Appl. Phys. 61, 36–44; Sep. 1986.

*Primary Examiner*—Donald J. Yusko
*Assistant Examiner*—Ashok Patel
*Attorney, Agent, or Firm*—Fitch, Even, Tabin & Flannery

[57] ABSTRACT

A field emission cathode of bio-molecular or eutectic composite microstructure having rod-like tips protruding from a uniform base and covered with a thin layer of semiconductor material for producing macroscopic beam current densities without formation of surface plasma.

4 Claims, 5 Drawing Sheets

FIELD EMISSION CATHODE OF BIO-MOLECULAR OR SEMICONDUCTOR-METAL EUTECTIC COMPOSITE MICROSTRUCTURES

BACKGROUND TO INVENTION

The present invention relates to field emission cathodes and, more particularly, to such a cathode of biomolecular or eutectic composite microstructure capable of macroscopic beam current densities of $J \geqq 100$ A/cm$^2$ without the formation of a surface plasma.

The need for high current density, high brightness, survivable cathodes is driven by several applications of interest, including microwave sources (C. W. Roberson, Proc. Soc. Photo-OOpt. Int. Eng. 453, 320 (1983), D. A. Kirkpatrick, G. Bekefi, A. C. DiRienzo, H. P. Freund, and A. K. Ganguly, Phys. Fluids B 1, 1511 (1989)) radars, communications, and ECRH heating of fusion plasmas, high power fast switches ("Vacuum Arcs, Theory and Applications," J. M. Lafferty ed., John Wiley & Sons (New York, 1980)), high gradient accelerators (J. LeDuff, Proc. Lin. Acc. Conf., 285, (Newport News, VA, 1988)), and electron beam processing of materials ("The New York Times," pp. D1, Jun. 20, 1990). The properties that constitute the ideal electron source vary from application to application. For some, the capability to operate for long pulses at high current density is the most significant improvement. For others, it is not so much the highest current densities that would be available, as it is a combination of a modest increase in available current density combined with an increase in operational lifetime.

The existing technology for electron beam sources can be broken down into four groups: (1) thermionic cathodes, (2) laser driven photo-cathodes, (3) classical field emission cathodes, and (4) exploding or plasma field emission cathodes. The existing state-of-the-art can be summarized as follows:

1. Thermionic cathodes use a thermally activated, low work function material to act as an electron beam source. Older technologies simply used a barium-oxide coating that was painted on the desired emission surface. New technologies use a porous dispenser matrix to gradually deliver a scandate compound to the cathode surface. Commercially available technology delivers 20 A/cm$^2$ for lifetimes longer than 1000 hours, but requires vacuum pressures less than $10^{-7}$ Torr and has a long list of materials that will chemically poison the surface even at that level. Notably excluded materials include hydrocarbons, flourocarbons, and stainless steel. Research cathodes (R. E. Thomas. J. W. Gibson, G. A. Haas, and R. H. Abrams, IEEE Trans. Elec. Dev. 37, 850 (1990)) have produced cathode current densities as high as 140 A/cm$^2$, but these require even higher vacuum standards and have problems with beam quality, reproducibility, and lifetime. All of these cathodes require a heater element to maintain the cathode surface at an elevated temperature anywhere between 900° and 2200° C.
2. Laser driven photo-cathodes (R. L. Scheffield, E. R. Gray, and J. S. Fraser, Nuc. Instr. Meth. A272, 222 (1988), C. Sanford and N. C. MacDonald, J. Vac. Sci. Technol. B 6, 2005 (1988)) use an intense pulse of light to photo-eject electrons from a low work function (typically Cesiated) surface. They can produce very high instantaneous current densities (>60 kA/cm$^2$), albeit for very short times. They require very high vacuum, with vacuum pressures in the range of $10^{-9}$ Torr or less. Other approaches, using bare metals such as Copper, operate in slightly poorer vacuum ($10^{-8}$ Torr) but have considerably poorer efficiency of conversion of the laser light.
3. Vacuum field emission cathodes are typically tungsten fibers, and are predominantly used in Scanning Electron Microscopes (SEM). They produce an electron beam by classical Fowler-Nordheim quantum tunneling of electrons from near the Fermi level into the vacuum. The large electric field that is required is obtained from the very large field enhancements near a sharp point. Beam brightness is very high, since the beam is essentially produced by a point-emitter. The current density is very high, but this is a single-tip emitter, and therefore the total current is very low. Other researchers (C. A. Spindt, K. R. Shoulders, and L. N. Heynick, U.S. Pat. Nos. 3,755,704 (1973), and 3,812,559 (1974), C. A. Spindt, I. Brodie, L. Humphrey, and E. R. Westerberg, J. Appl. Phys. 47, 5248 (1976), C. A. Spindt, C. E. Holland, and R. D. Stowell, Appl. Surf. Sci, 16, 268 (1983), G. J. Campisi and H. F. Gray, Mat. Res. Soc. Symp. Proc. 76, 67 (1987), H. H. Busta, R. R. Shadduck, and W. J. Orvis, IEEE Trans. Elec. Dev. ED-36, 2679 (1989)) are pursuing the same objective using microlithographic approaches that produce "gated" arrays of small pyramids or cones.
4. Exploding or plasma field emission cathodes (D. D. Hinshelwood, Naval Research Laboratory Memorandum Report No. 5492 (1985)) are the cornerstone of the extremely high pulsed power regime. Cathode current densities in excess of 1 MA/cm$^2$ have been demonstrated. They tolerate moderate to poor vacuum quite well. The quality of the electron beam is not high, but high quality beams may be obtained by passing the electrons through an emittance filter. This may reduce the beam current to 1% of its initial value, but one still has a high current beam that is now also a high quality beam. The truly significant drawback to these cathodes is their inherent inability to operate for long pulses (>1 μsec) or at a high repetition rate (>10 Hz).

The basic limitations for these four types of electron beam sources dictates which is used for a specific application. Most existing technology utilizes thermionic emitters. Some high power research experiments use plasma field emission cathodes because of their high instantaneous power capability and their ease of operation. Classical field emission cathodes are almost exclusively used in SEMs, and laser photo-cathodes are still mostly in a research phase.

The class of thermionic emitters is the dominant segment of the electron beam source pie because of its DC and long pulse capability. All radars, all RF sources that drive RF linacs, all conventional tubes, and almost all of the commercial electron source demand is currently utilizing thermionic cathodes. Almost any application that requires substantial average power capability must use a thermionic emitter.

Applications that require high quality, high current electron beams are also limited by the thermionic emitters. The normalized electron beam brightness is defined as $$B_n = \frac{I}{\pi^2 \epsilon_n^2} = \frac{J}{\pi\,(\gamma\beta\delta\theta)^2} \quad (1)$$

where J is the cathode current density in $A/cm^2$, $\gamma = 1 + (eV/m_oc^2)$ is the relativistic factor, $\beta = v/c$ is the electron velocity normalized to the speed of light, and $\delta\theta = v\perp/v\,||$ is the FWHM in the transverse velocity spread angle of the electron beam distribution. The maximum beam brightness available from a thermionic emitter is theoretically on the order of $10^8$ $A/cm^2$-$rad^2$. But achieving a high beam current density in addition to this beam brightness demands magnetic compression of the emitted beam. Creating very accurate magnetic fields over any substantial area is extremely difficult, and this limits the practically available brightness for a ~1 A beam using a thermionic emitter to ~$10^6$ $A/cm^2$-$rad^2$.

A device that is most significantly affected by electron beam brightness is the free-electron laser (FEL). For the FEL it is the brightness of the electron beam that determines the characteristics of the device. The minimum operational wavelength is determined by the electron beam emittance, $\epsilon_n = (1/\pi)\sqrt{1/B_n}$, $$\lambda_{rad} > \pi\epsilon_n \quad (2)$$

Given a desired operational wavelength, the electron beam brightness determines how much beam current can participate in the interaction. This in turn determines whether the interaction will be high gain, low gain, or no gain. Existing technology for thermionic emitters makes 10 μm about the transition wavelength for the high gain to low gain regimes, and optical wavelengths in the blue the transition from the low gain to no gain regimes. Increasing the available beam brightness shifts these transition points to shorter wavelengths.

The other major category of electron sources, explosive or plasma field emission cathodes, is limited in pulse length to approximately 1 μsec due to the inherent presence of an expanding cathode plasma. More particularly, field emission cathodes operate by applying a large electric field to an emission surface, perhaps reactor grade graphite (carbon). The large field draws electrons out of the materials by quantum tunneling. Presently, this process describes only the initial phase of "turn-on". The initial current generated in this phase is emitted from small microscopic protrusions in the surface of the material; the large currents drawn through these small tips results in large local Ohmic heating of the tips, which subsequently ablate and produce a cathode surface plasma. Subsequent emission of electrons occurs from this intermediate of the cathode plasma, which has a very low work function and allows for very high current densities to be generated ($I > 100{,}000$ $A/cm^2$). The significant drawback of this process is that the generated cathode plasma typically expands towards the anode at a rate of 1–2 cm/μsec, which limits the useful pulse length and precludes repetitively pulsed operation. More specifically, the expanding plasma reduces the effective cathode-to-anode distance because emission occurs from the leading edge of the plasma. The decreased cathode-anode spacing increases the current which is drawn, since this type of situation is described by Child-Langmuir space-charge limited flow, resulting in electron gun impedance collapse. A significant advantage to these cathodes is their relative insensitivity to the vacuum environment. They operate quite well in vacuum of $10^{-4}$ Torr, and do not poison. This makes them ideal electron beam sources for experimental apparatus that do not require long pulse or repetitively pulsed capability. They are also inexpensive and do not require any special handling.

In view of the foregoing discussion it should be apparent that there is a continuing need for an electron beam source which combines the advantages of the four groups as described and which reduces to a minimum the stated shortcomings or disadvantages. The present invention satisfies such a need by providing a field emission cathode which combines the advantages of both thermionic and plasma field emission cathodes. Like the thermionic cathodes, they have the capability to operate DC or repetitively pulsed. Like the plasma field emission cathodes, they are inexpensive, require minimal care in handling, operate well in moderate vacuum, and do not poison. They do not require a heater, nor its associated power supply. Cathode current densities $J > 200$ $A/cm^2$ and brightness $B_n > 10^7$ $A/cm^2$-$rad^2$ are possible.

SUMMARY OF INVENTION

Generally speaking, to provide the foregoing advantages, the field emission cathode of the present invention comprises a bio-molecular or eutectic composite microstructure having an array of microscopic rod-like tips protruding from a base. The tips are covered with a thin layer of a semiconductor material such as silicon or a metal such as Yttrium. In an anode-cathode geometry at moderate vacuum or controlled atmosphere and in a microscopic electric field (e.g., 20–45 kV/cm), such cathodes produce electron beams having a current density $J \geqq 100$ $A/cm^2$ without the formation of a surface plasma.

DETAILED DESCRIPTION OF INVENTION

All high current density cathodes share some fundamental properties. The Child-Langmuir space-charge limited current density $$J = 2.34 \times 10^{-6} \frac{V^{3/2}}{d^2} \quad (3)$$

governs the maximum current density that can be drawn from an infinite parallel plate diode with cathode-anode separation of d and applied voltage V. This current density is obtained by calculating the point at which the cathode surface is completely shielded from the applied electric field. This shielding effect is due to the electron cloud of the generated electron beam. The presence of background plasma due to ionization by the electron beam modifies this result upwards. For high vacuum systems (pressure $<10^{-7}$ Torr) this effect is negligible. For more moderate vacuums, the precise effect depends on the degree of ionization and can be greater than a factor of two. Another aspect of the self-electric fields associated with high current density cathodes is the design of electron guns to use them. An electron gun operating near the Child-Langmuir limit necessarily experiences a substantial modification of its electric field structure during the turn-on phase of the electron beam. Unless the electron gun is designed to be dominated by an externally applied magnetic field this places a high degree of difficulty on the electron gun design. Plasma field emission cathodes, almost by definition, operate at the Child-Langmuir limited current.

Figure 1A:
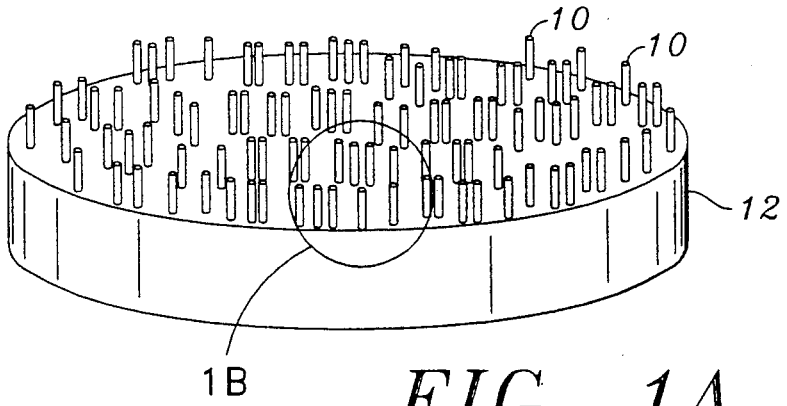
FIG. 1A is a diagramic representation of a self-assembling bio-molecular microstructure comprising a basic portion of the cathode of the present invention.
Figure 1B:
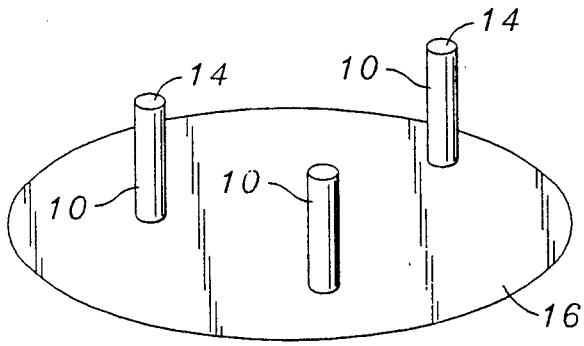
FIG. 1B is a enlarged portion of the cathode shown in FIG. 1A.

In the present invention, the cathode materials are moderately uniform, irregular array of classical field emitters. Each emitter tip is much like a tungsten filament used in a SEM. As classical field emitters, the Fowler-Nordheim emission current is given by $$J = \frac{A(\beta E)^2}{\phi t^2(y)} \exp\left(-B\frac{\phi^{3/2}v(y)}{\beta E}\right) A/\text{cm}^2, \quad (4)$$

where A and B are constants, $\phi$ is the work function of the emission material, E is the applied electric field, $\beta$ is the field enhancement factor due to local geometry, and t(y) and v(y) are very weak functions of the work function and electric field (values for these constants and coefficients are given in the next section). As can be seen from the $\beta^2E^2 \exp(-\alpha/\beta E)$ dependence of the current density J, this type of emission is very sensitive to the electric field at the emission surface. For a 5 eV work function material, and an applied electric field of 30 kV/cm, an increase in the field enhancement factor, $\beta$, from 2000 to 5000 results in a two order of magnitude increase in the emission density. Clearly, operation of this type of cathode near the Child-Langmuir limit would be unstable. As will be described hereinafter, in the cathode of the present invention, external current limiting circuits or non-linear current saturation effects in certain types of semiconductors or metals are used to limit the emission density and prevent the formation of surface plasmas. In this regard, as will be described hereinafter and as evidenced by my experimental data, in order to produce an array of emission sites which can turn on yet not explode to form a cathode plasma, the emission needs to be controlled. I accomplish such emission control by forcing current flowing into a vacuum or contolled atmosphere (e.g. a non-oxidation atmosphere of Argon, Helium or Neon) to flow through semiconducting or metal materials, which have a very high electron mobility but a low number of electrons in the conduction band (e.g. silicon and other materials having similar current-electric field or emissivity-temperature characteristics such as Yttrium). For an emission tip 0.5 $\mu$m in diameter, 200 $\mu$A of current may be safely drawn without nearing the melting point of Silicon. An average tip-to-tip spacing of 10 $\mu$m yields a tip density of $10^6$ tips/cm$^2$, and a safe current density level of 200 A/cm$^2$ without producing a cathode plasma. The absence of a cathode plasma allows this type of field emission cathode to operate for long pulses as well as in a rapidly, repetitively pulsed mode. This invention covers the application of a wide class of semi-conductor eutectic composites which produce microscopic rod-like structures embedded in a surrounding matrix. Basic forms of such structures are commonly available through such institutions as GTE Laboratories, Waltham, Mass., and include, for instance, Si—$TaSi_2$ and Ge—$TiGe_2$. Then, as shown in FIGS. 1A and 1B, such structures can be etched back by chemical processes which leave exposed the rods 10 protruding out and above the surrounding matrix material 12. This invention covers both the case where the rods are the semiconducting phase and the base or matrix is conducting, as well as the case where the base is semiconducting and the rods are conducting. In either structure, according to my invention, the cathode is over-coated with a thin coating 14 of a semiconductor, e.g. amorphous Silicon and/or a thin layer of gold followed by a thin layer of silicon or by a thin coating of a metal such as Yttrium.

More particularly in the present invention, the cathode materials are open, ungated field emission arrays that utilize a high density of emission sites, across macroscopic areas, to achieve macroscopic current densities. The emission sites are typically rods or spikes protruding from a background matrix (see FIG. 1). The electric field enhancement associated with the rod or spike length, its aspect ratio, and the radius of curvature of is tip must be large in order to achieve the $10^7$–$10^8$ V/cm field magnitudes necessary to drive significant quantum field emission. Micro-tip currents of ~10–100 $\mu$A are achievable with fields in this range, depending on the work function of the surface materials and the effective emitting area. In order to arrive at macroscopic current densities of ~100 A/cm$^2$ it is necessary to pack $10^6$–$10^7$ tips/cm$^2$. This implies a tip-to-tip spacing of less than 10 $\mu$m, and through the field enhancement requirement, consequently requires a tip or edge radius of curvature less than ~200 Å.

There are several ways to achieve this combination of parameters. Well known microlithographic techniques of fabricating many-tip arrays have been eminently successful, however, attempts to extend this technique to million-tip arrays have not been successful.

Unlike the microlithographically prepared gated field emitter arrays, the cathode materials of the present invention preferably use microstructure templates and current limiting surface coatings to generate stable Fowler-Nordheim type classical field emission. SEM images of two such microstructures are shown in FIGS. 2 and 3.

Figure 2:
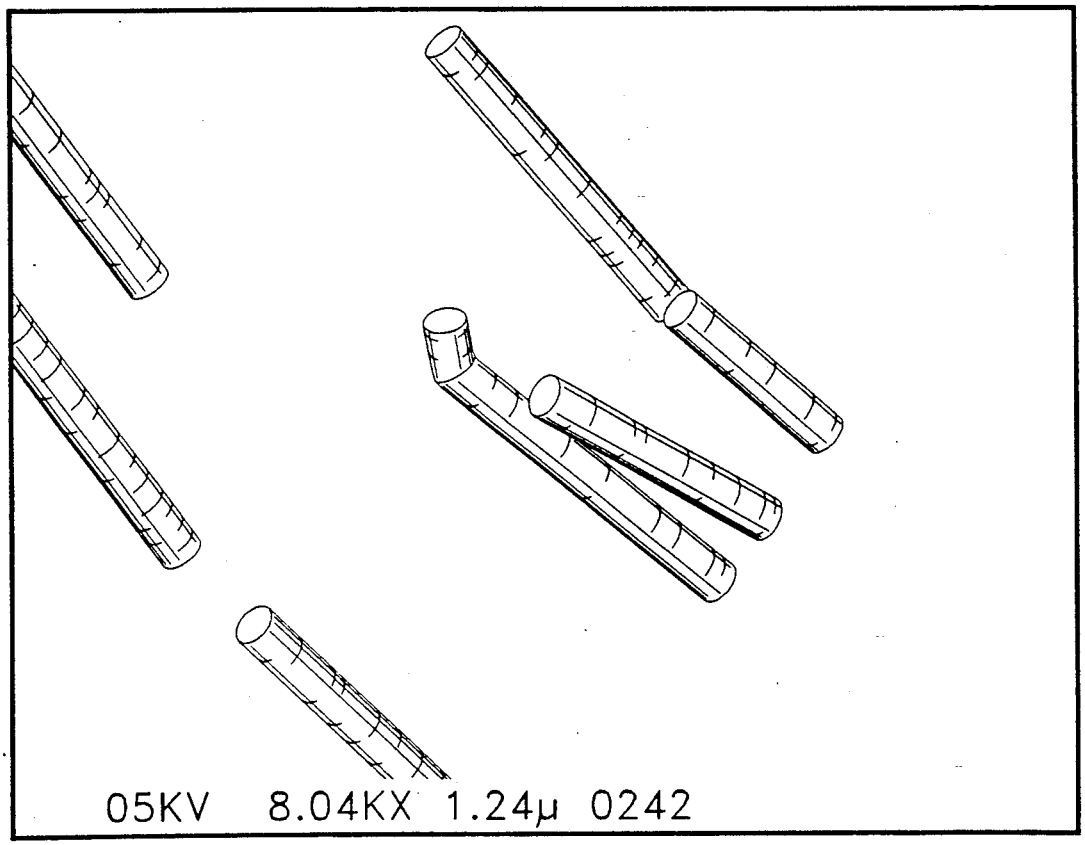
FIG. 2 is a scanning electron microscope image of a biologically derived cathode surface having a high density of emitters.

The first material, shown in FIG. 2, may be derived for example from a diacetylenic lipid ($DC_{8,9}PC$) that forms tubule-like structures (P. Yager and P. E. Schoen, Mol. Cryst. Liq. Cryst. 371 (1984), P. Yager, P. E. Schoen, C. Davies, R. Price, and A. Singh, Biophys. J. 48, 899 (1985), J. M. Schnur, R. Price, Schoen, P. Yager, J. M. Calvert, J. Georger, and A. Singh, Thin Solid Films 152, 181 (1987), J. H. Georger, A. Singh, R. R. Price, J. M. Schnur, P. Yager, and P. Schoen, J. Am. Chem. Soc. 109, 6169 (1987), F. Behroozi, M. Orman, R. Reese, W. Stockton, J. Calvert, F. Rachford and P. Schoen, J. Appl. Phys., 68,3688 (1990). This approach has already produced a uniform, irregular array of 0.4 μm diameter, 10 μm tall right circular cylinders 10, protruding from a gold-sputtered background surface and separated by an average of about 10 μm.

Figure 3A:
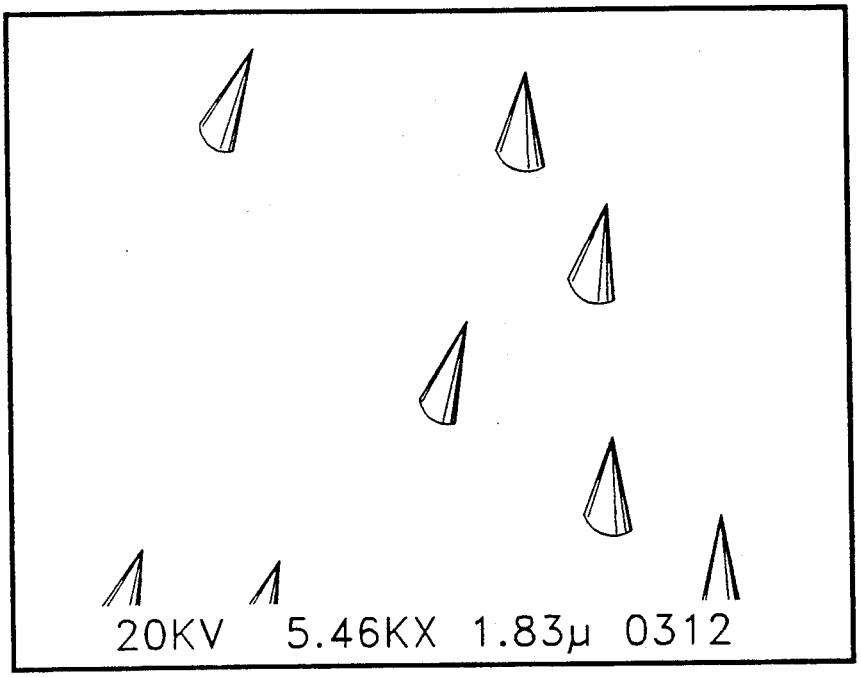
FIGS. 3A and B are scanning electron microscope image of a semiconductor-metal eutectic composite cathode surface, FIG. B being a close-up of a tip shown in FIG. 3A.
Figure 3B:
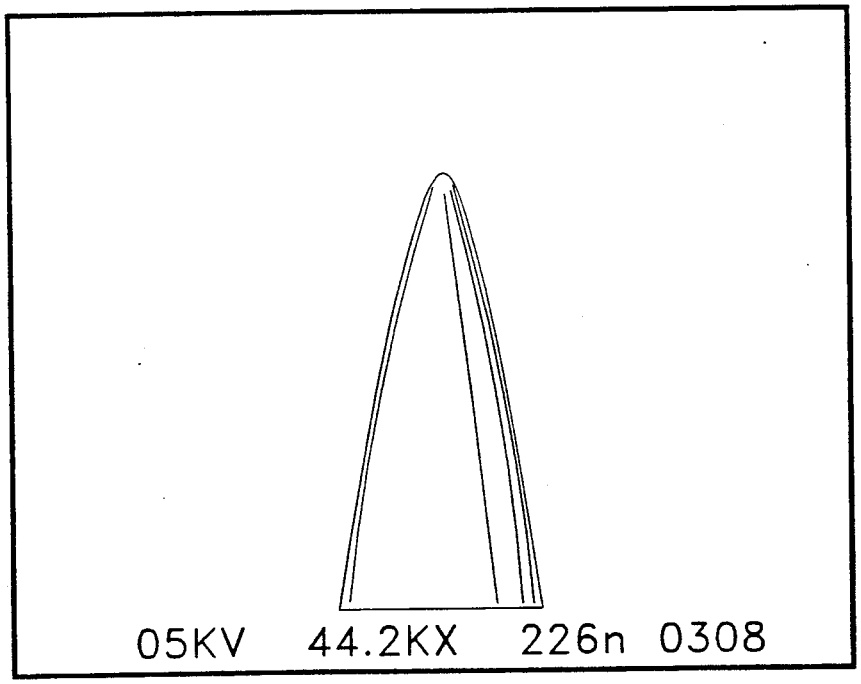

An alternate means to achieve a similar cathode surface micro-morphology is shown in FIG. 3. This material is a metal-semiconductor eutectic composite such as a silicon-tantalum-disilicide eutectic composite or a germanium titanium diagermicide eutectic composite (U.S. Pat. No. 3,720,856, M. Ditchek, T. R. Middleton, P. G. Rossoni, and B. G. Yacobi, Appl. Phys. Lett. 52, 1147 (1988), M. Levinson, B. M. Ditchek, and B. G. Yacobi, Appl. Phys. Lett. 50, 1906 (1987), B. M. Ditchek and M. Levinson, Appl. Phys. Lett. 49, 1656 (1986)). The protruding sharp, pointed rods are the minority tantalum-disilicide. This material is a good electrical conductor. The matrix is a poly-crystalline rod of silicon. The silicon matrix has been etched preferentially to produce the structure shown.

Past and ongoing investigations into gated field emitter structures at SRI by C. A. Spindt and co-workers also suggest the potential and utility of my approach. They have successfully demonstrated individual emitter tip currents as high as 500 μA without the formation of plasma or catastrophic failure of the structure. While the geometric properties of their tip structure are similar to mine, there are major differences between our approaches in the areas of fabrication techniques, the presence or absence of a nearby ($\Delta x = 1$ μm) gate electrode, and emission control to prevent surface plasma.

To estimate the performance of my advanced cathode material requires evaluation of the Fowler-Norheim emission density and the effective emission area. For the sake of brevity, this calculation is performed here for the case of the tubule cathode. Application to the eutectic cathode is straightforward. The Fowler-Nordheim emission density is given by $$J = \frac{A(\beta E)^2}{\phi t^2(y)} \exp\left(-B\frac{\phi^{3/2}v(y)}{\beta E}\right) A/\text{cm}^2 \quad (5)$$

where $A = 1.54\times10^{-6}$, $B = 6.8\times10^{7}$, $y = 3.79\times10^{-4}(E^{1/2}/\phi)$, $t^2(y) = 1.1$, $v(y) = 0.95 - y^2$, E is the applied electric field in V/cm, $\beta$ is the field enhancement factor due to local geometry, and $\phi$ is the work function in eV of the surface emission material. For $\beta E = 1.5\times10^8$ V/cm and a work function of 5 eV, $J = 3.6\times10^9$ A/cm$^2$. When the effective emission area reduction factor is taken into account, this corresponds to 291 μA per tip. For an enhanced electric field value of $\beta E = 0.6\times10^8$ V/cm, this is reduced to less than 1 μA per tip.

Figure 4:
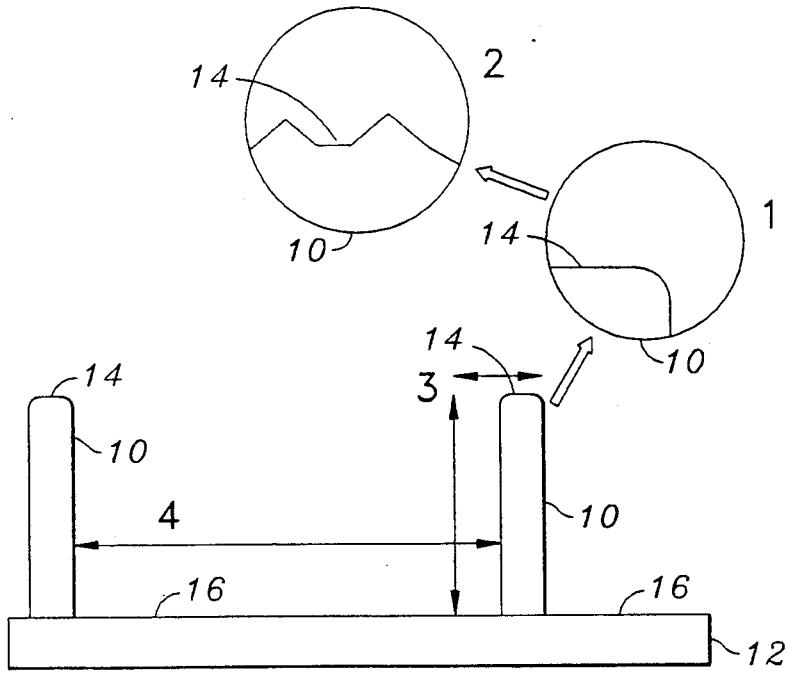
FIG. 4 is a composite diagramic representation of a portion of a cathode surface in accordance with the present invention and showing at 1, 2, 3, and 4 sources of electric field enhancement and diagradation for the cathode structure; 1 being the radius of curvature of the exposed tip, 2 being atomic scale surface protrusions, 3 being the height and width of the exposed tip and 4 being the distance between adjacent tips.
Figure 5:
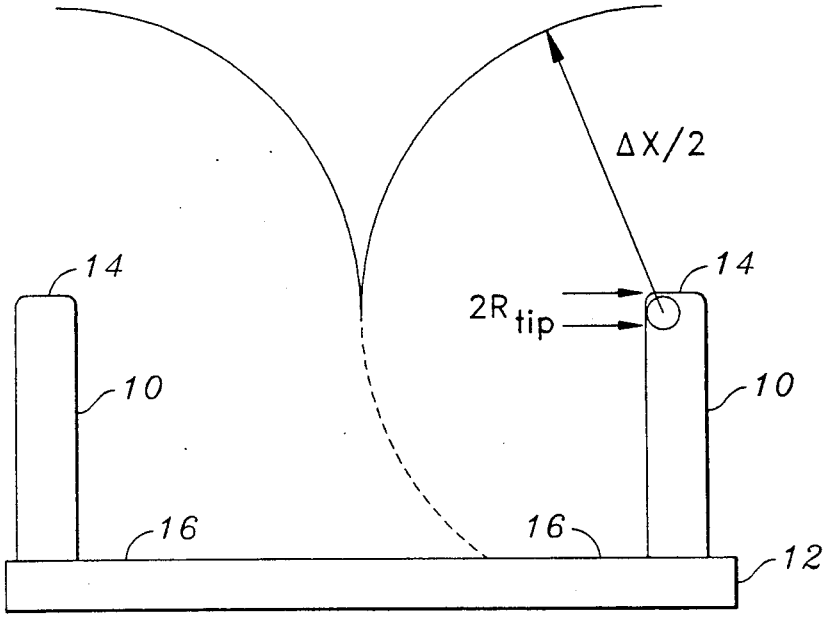
FIG. 5 is a diagramic representation of a portion of a cathode surface similar to FIG. 4 and illustrating the field enhancement due to the radius of curvature of the exposed tip.

The effective electric field value of $\beta E = 0.6 - 1.5\times10^8$ V/cm requires substantial field enhancement to obtain, given a desired starting value of 20 kV/cm. For the structure shown in FIG. 1, there are three sources of field enhancement, and one source of field suppression. Considering the tubule cathode structure shown in FIG. 4, the three sources of enhancement are (1) the edge radius of curvature of the exposed tip, (2) atomic scale surface roughness of the material on this edge, and (3) the height and aspect ratio of the exposed tip. This calculated field enhancement is an overestimate due to the nature of the calculation for item (3), which assumes a single isolated tip on a flat surface. An estimate of the effect of neighboring tips on this calculation can be made by comparing the field gradient at the geometric middle between two emitter tips. These enhancement factors are calculated as follows:

1. Radius of curvature of the exposed tip: approximate the calculation as that of the field enhancement due to two concentric spheres, with radii $R_{tip}$ and $\Delta x/2$ (see FIG. 5). With a nominal voltage $V_A$ applied between the two spheres, the electric field at the inner sphere is $$E(R_{in}) = \frac{V_A}{R_{out} - R_{in}} \times \frac{R_{out}}{R_{in}},$$

which corresponds to a field enhancement factor $R_{out}/R_{in} = \frac{1}{2}\Delta X/R_{tip}$. For a tip radius of 500 Å and a tip separation of 10 μm, this gives an enhancement factor of 100. Reduction of the emitter tip radius to 100 Å increases this factor to 500. SEM micrographs of the emitter surface place an upper limit of 200 Å on the edge radius of curvature.

2. Atomic scale surface roughness: measurements by Spindt et al. at SRI have observed a field enhancement effect attributed to atomic scale surface roughness. This enhancement factor is observed to be approximately 3, but with the additional aspect that the effective emission area is dramatically reduced by a factor of 10,000.

3. Height and aspect ratio of the exposed tip: the field structure surrounding a Lorentzian-like surface bump has been calculated to be (Y. Y. Lau, J. Appl. Phys. 61, 36 (1987)).

$$E_x + iE_y = \frac{-iE_0[x - i(y + b)]}{\{[x - i(y + b)]^2 + a^2\}^{1/2}} \quad (6)$$

where a and b are conformally mapped parameters from the height and width of the bump:

$$b \approx (w/3.464)\left[1 + \frac{w}{3.464h}\right]; a \approx h + \frac{w}{3.464} \quad (7)$$

An estimate of the Lorentzian profile that closely fits the borders of the exposed emitter in the neighborhood of the tip gives $w \sim 4\times R_{cyl}$. For a single protrusion of height $h = 10$ μm, width $w = 2$ μm, we have $a \sim 10$, $b \sim 0.56$, and letting $\delta = b/a$ $$E_y \approx iE_0 \times \left\{ \frac{(b+h)}{[a^2-(b+h)^2]^{1/2}} \right\} \approx E_0 \times \frac{1}{\sqrt{2}} \frac{1}{\delta} \sqrt{1+\delta} \approx E_0 \times 10 \quad (8)$$

giving a field enhancement factor of about 10.

4. Degradation of (3) due to neighboring tips: the error incurred by neglecting the presence of other tips in the calculation of the previous enhancement factor can be estimated by calculating $E_x$, the transverse field component, at a distance from the one tip corresponding to the midpoint between two tips. A fully accurate, many-tip calculation would clearly give $E_x=0$. Again, using the field structure above, for $x=5$ μm, $y=10$ μm we calculate $E_x/|E|=0.1$. Therefore I estimate a calculation of the enhancement factor in (3) to be too large by about 10%.

The complete enhancement factor can be approximated by multiplying together the individual enhancement factors for the edge radius of curvature, micro-surface protrusions, the tip aspect ratio, and the presence of other tips $$\beta=(250)\times(3)\times(10)\times(0.9)=6750 \quad (9)$$

and the local elecric field is $$E_k=E_o\times\beta=(20kV/\text{cm})\times 6750=1.35\times 10^8 V/\text{cm}. \quad (10)$$

giving us the higher end of the $0.6\text{-}1.5\times 10^8$ V/cm enhanced electric field quoted previously.

The last element of the design is the method used to limit the current at the emitter tips. This limiting is necessary to avoid current runaway at the tips and the production of undesired surface plasmas. In the case of the gated field emitter arrays studied by Spindt et al., the current limiting is achieved by mounting the emitter tips on a doped silicon crystal. In the present invention, and as shown in FIG. 1B, such limiting is achieved by coating 14 the emission surface itself with a coating of silicon or Yttrium. This approach has the advantage that the current limiting occurs at the emitter tip, and therefore each tip is protected. This is an advantage over the approach where the emitter tips are mounted on a macroscopic silicon crystal, wherein the current limiting is more macroscopic and current "hogging" can occur. Moreover, thin metal or semiconductor coating improves the uniformity of the curvature or sharpness of all the tips. Such uniformity of tip structure improves the uniformity of the field enhancement for the tip array. The uniformity of the sharpness of the tips will also improve the uniformity of current density of the resulting beam from the array.

Furthermore, in the field emission-cathode comprising a metal-semiconductor composite structure, a radial Schottky barrier is present in the matrix around each protruding tip. In the present invention, the barrier is bridge as shown in FIG. 1B, by a layer of a metal such as gold having a thickness of about 150A overlaying the matrix. In effect, with application of the electric field, the gold layer provides an avenue for the flow of electrons from the matrix materials over the barrier up the tips to exit at the sharp point thereof.

The expectations for high beam brightness from these cathode materials according to the present invention are based on the analogy with velvet or felt cathodes. Measurements with velvet cathodes have shown that the dominant source of electron beam emittance is that due to the surface roughness. Given my cathode surface structure, this will also be the dominant source of electron beam emittance. For a surface with roughness of characteristic height h and width w (in 100's of μm), and for a cathode not operating in the space-charge limited regime, the maximum normalized spread angle is calculated to be (Y. Y. Lau, J. Appl. Phys. 61, 36 (1987)).

$$\gamma\beta\delta\theta_{max} = 0.15\sqrt{E_0}\ \frac{h}{(h^2+w^2)^{1/4}} \quad (11)$$

where $E_o$ is the applied macroscopic electric field in MeV/cm. This maximum in the perpendicular electron velocity occurs for electrons emitted from about 40% down the side of the characteristic bump. In the present invention, however, the electron emission is occurring at or near the top of the protrusion. This reduces the maximum normalized spread angle to $$\gamma\beta\delta\theta_{max} = 0.05\sqrt{E_0}\ \frac{h}{(h^2+w^2)^{1/4}} \quad (12)$$

For parameters of $h=10$ μm, $w=0.4$ μm, and $E_o=20$ kV/cm: $\gamma\beta\delta\theta_{max}=2.2$ mrad. This leads to a normalized brightness of $$B_n = \frac{I}{\pi^2\epsilon_n^2} = \frac{I}{\pi r^2}\ \frac{1}{\pi(\gamma\beta\epsilon\theta_{max})^2} = \frac{1}{\pi}\ \frac{200\ A/cm^2}{\pi(2.2\ \text{mrad})^2} = 1.3\times 10^7 A/cm^2-\text{rad}^2 \quad (13)$$

This brightness exceeds presently available parameters by approximately one to two orders of magnitude.

The expectations for long operational lifetime stem from two sources. First and foremost are the lifetime measurements already performed by Spindt et al on their gated field emitter arrays. In cases where the gate electrode did not fail, lifetimes well in excess of 1000 hours have been demonstrated. The other lifetime limitation is taken from calculations of the surface erosion due to back-ion bombardment. The rate of erosion is governed by several parameters, including the electron beam voltage, the background vacuum pressure, the surface material, and the electron gun structure itself. The highest rate of surface erosion occurs for ions striking the cathode surface with energies around 1 keV. At this energy the probability for sputtering is the highest. Well above this energy, the ions pass through the surface structure with very little probability of interaction. Well below this energy and the ions possess too little energy to do sputtering damage. Clearly, a gun design would want to minimize the number of ~1 keV ions that are allowed to track to the cathode surface. Taking as a minimum a layer of thickness 1 mm for the volume creating ~1 keV ions, a background pressure of $10^{-6}$ Torr, and a 1-1 ion-sputtering ratio, less than 1 μm of surface material is lost in greater than 1000 hours of exposure.

EXPERIMENTS AND RESULTS

Experiments to date have focussed on the demonstration of low turn-on macroscopic electric fields, the fabrication of the suitable surface microstructure, measurements of the I-V characteristics, and measurements of the resultant beam emittance, the uniformity of turn-on across the cathode surface, and the cathode lifetime.

Figure 6:
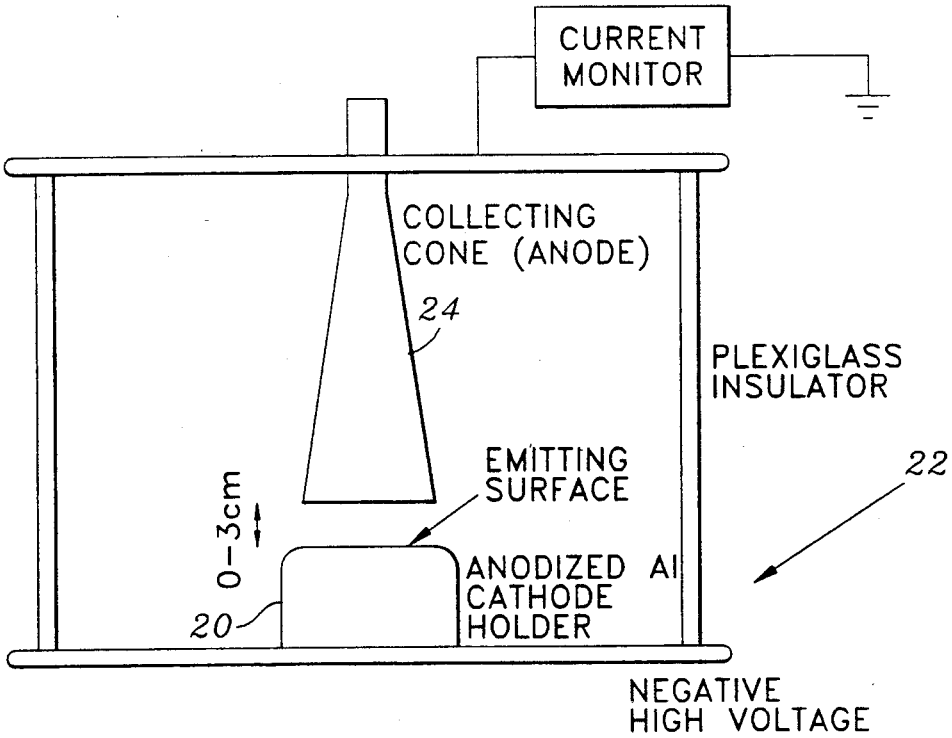
FIG. 6 is a diagramic representation of a test strip used to measure the performance of the cathode of the present invention.
Figure 7:
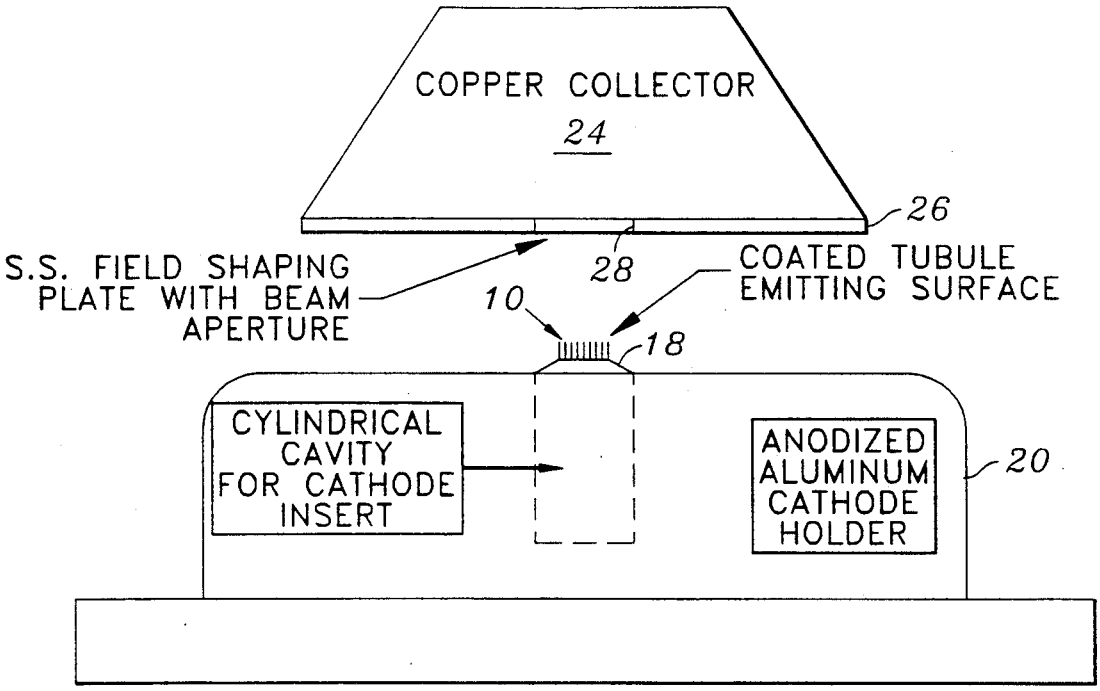
FIG. 7 is an enlarged showing of the portion of the test setup of FIG. 6 including the cathode holder and electron collector.

The cathode measurements presented here used a simple parallel plate cathode-anode geometry as shown in FIG. 6 and FIG. 7. The processed emitters are mounted on either aluminum or OFHC copper stubs 18, that in turn are mounted in an anodized aluminum cathode holder 20. The exposed surface of the cathode holder is anodized to prevent unwanted emission from the aluminum surface, while the sides of the cylindrical hole are left uncoated to facilitate good electrical and thermal contact with the aluminum cathode holder. The entire cathode assembly is mounted in a cathode test stand 22, and is placed opposite a long, OHFC copper cone beam collector 24, which is held at ground potential. The outside of the cone is covered with refrigeration tubing which flows water for cooling the collector. The face of the cone is covered with a stainless steel plate 26, which has a hole 28 cut through the center to facilitate passage of the electron beam. The plate is to ensure an approximately planar field structure in the cathode-anode gap. A calibrated current viewing resistor monitors the current in the ground return from the anode. The vacuum is provided by a cold-trapped diffusion pump, and was typically in the range $2\text{-}5\times10^{-5}$ Torr. All of the test results presented here are DC measurements.

Proof-of-principle tests were performed with the cathode emitter shown previously in FIG. 2. That surface was coated with successive 150 Å layers of gold and amorphous silicon. Application of a macroscopic 20 kV/cm electric field produced a measured current density of 38 mA/cm$^2$ for a duration of 10 seconds. Subsequent inspection of the cathode surface with a SEM showed no observable damage due to the emission. Using the simple template as the cathode emitter, with no coatings of gold or silicon, produced no observable emission. With only the gold coating, the cathode was observed to form an unstable plasma discharge at approximately the same 20 kV/cm.

Figure 8:
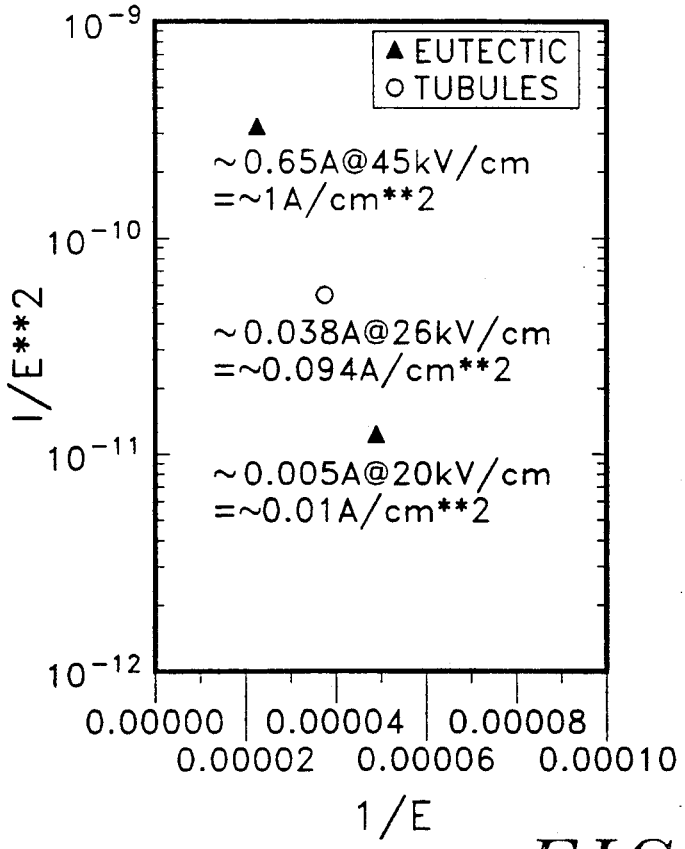
FIG. 8 is a graph depicting a summary of performance of the tested cathodes.

For the case of the silicon-tantalum-disilicide emitter shown in FIG. 3, the application of macroscopic electric fields as high as 45 kV/cm failed to produce any measurable emission. Subsequent coating of the surface with a 50 Å coating of gold produced an unstable plasma discharge at approximately 20 kV/cm applied field. Subsequent coating of this surface with 50 Å of amorphous silicon produced approximately 10 mA/cm$^2$ for an applied electric field of 20 kV/cm, and approximately 1 A/cm$^2$ for an applied field of 45 kV/cm. The cathode emission surface was approximately 0.7 cm$^2$ in area, and the latter current density measurement corresponded to a total emission current of approximately 0.7 A. Due to limitations of the available power supply, this was achieved with an RC charge-discharge circuit. The measurements were therefore made with an effectively varying voltage (22-18 kV) over a decay time of about 10 seconds. Due to the variational nature of the voltage and the crudeness of the measurement technique, these current measurements may have an error as large as 50%. The measurements do, however, serve as proof of principle of the utility of the microstructures as field emitter templates. These data for both the eutectic composite cathode as well as the tubule composite cathode are shown in FIG. 8.

While particular structure and techniques have been described above, changes and modifications may be made without departing from the present invention as defined by the following claims.

I claim:

1. A field emission cathode for an electron-beam source for producing macroscopic beam current densities without forming a surface plasma, comprising:

a semiconductor-metal eutectic composite microstructure including an array of rod-like tips protruding from a matrix;

a coating of a semiconductor and/or a metal on a top of the tips; and a layer of a metal contacting both the tips and the matrix for bridging Schottky barriers between the matrix and the tips.

2. The cathode of claim 1 wherein the layer of metal comprises gold.

3. An electrode beam source comprising:

a closed chamber;

an anode in the chamber;

a field emission cathode in the chamber spaced from the anode and comprising a semiconductor-metal eutectic composite microstructure including an array of rod-like tips protruding from a matrix, a coating of a semiconductor and/or a metal on top of the tips and a layer of metal contacting both the tips and the matrix for bridging Schottky barriers between the matrix and the tips;

means for developing a controlled atmosphere in the chamber; and means for generating an electric field between the anode and the cathode to produce an electron beam between the cathode and the anode having macroscopic beam current densities without forming a surface plasma on the cathode.

4. The source of claim 3 wherein the layer of metal comprises gold.

* * * * *

UNITED STATES PATENT AND TRADEMARK OFFICE

CERTIFICATE OF CORRECTION

PATENT NO. : 5,138,220

DATED : 8/11/92

INVENTOR(S) : Kirkpatrick

It is certified that error appears in the above-identified patent and that said Letters Patent is hereby corrected as shown below:

Column 3, line 10, change "$V_\perp/v_\parallel$" to --$v_\perp/v_\parallel$--. Column 7, line 14, change "(1990)" to --(1990)).--. Column 9, line 63, change "bridge" to --bridged--. Column 9, line 63, after "layer" insert --16--. Column 10, lines 35-38, change " $\frac{I}{\pi r^2}\frac{1}{\pi(\gamma\beta\epsilon\theta_{max})^2} = \frac{1}{\pi}\frac{200\,A/cm^2}{\pi(2.2\,mrad)^2}$ " to -- $\frac{I}{\pi r^2}\frac{1}{\pi(\gamma\beta\delta\theta_{max})^2} = \frac{1}{\pi}\frac{200\,A/cm^2}{(2.2\,mrad)^2}$ --.

Signed and Sealed this

Fifth Day of October, 1993

Bruce Lehman

*Attest:*

BRUCE LEHMAN

*Attesting Officer*

*Commissioner of Patents and Trademarks*